US008079236B2

(12) United States Patent
Willner et al.

(10) Patent No.: US 8,079,236 B2
(45) Date of Patent: Dec. 20, 2011

(54) METHOD AND DEVICE FOR WINDING KNITTED NETS

(75) Inventors: Horst Willner, Erbach (DE); Kurt Gebhardt, Erbach (DE); Lutz Kaufmann, Michelstadt (DE); Jürgen Piazzi, Michelstadt (DE)

(73) Assignee: RKW SE, Frankenthal (DE)

( * ) Notice: Subject to any disclaimer, the term of this patent is extended or adjusted under 35 U.S.C. 154(b) by 849 days.

(21) Appl. No.: 10/590,154

(22) PCT Filed: Feb. 16, 2005

(86) PCT No.: PCT/EP2005/001561

§ 371 (c)(1),
(2), (4) Date: Jun. 7, 2007

(87) PCT Pub. No.: WO2005/083167

PCT Pub. Date: Sep. 9, 2005

(65) Prior Publication Data

US 2007/0234762 A1 Oct. 11, 2007

(30) Foreign Application Priority Data

Feb. 19, 2004 (DE) ..... 10 2004 008 105
Feb. 19, 2004 (DE) ..... 20 2004 002 592 U

(51) Int. Cl.
*D04B 15/88* (2006.01)

(52) U.S. Cl. ..... 66/151; 242/548; 242/566; 242/615

(58) Field of Classification Search ..... 242/548, 242/566, 563.1, 593, 615, 615.3; 66/151
See application file for complete search history.

(56) References Cited

U.S. PATENT DOCUMENTS

| | | | | |
|---|---|---|---|---|
| 3,433,034 | A | 3/1969 | Traumuller | |
| 3,646,782 | A * | 3/1972 | Kohl | 66/87 |
| 4,056,240 | A * | 11/1977 | Gallini et al. | 242/364.11 |
| 4,781,291 | A * | 11/1988 | VanGinhoven | 206/83.5 |
| 5,104,714 | A * | 4/1992 | Leiber et al. | 428/131 |

FOREIGN PATENT DOCUMENTS

| | | |
|---|---|---|
| DE | 1 635 954 A1 | 6/1971 |
| DE | 200 08 520 U1 | 7/2000 |
| EP | 1 369 516 A1 | 12/2003 |

* cited by examiner

*Primary Examiner* — Sang Kim
(74) *Attorney, Agent, or Firm* — Fanelli Haag PLLC

(57) ABSTRACT

The invention relates to a process and a device for the winding of nets (1) knitted from thrums (2) and wefts (3) to a given winding width at a winding point. For this the thrums (2) of the knitted net are guided along spacer elements (5, 9, 14) ahead of the winding point.

21 Claims, 3 Drawing Sheets

METHOD AND DEVICE FOR WINDING KNITTED NETS

Figure 1:
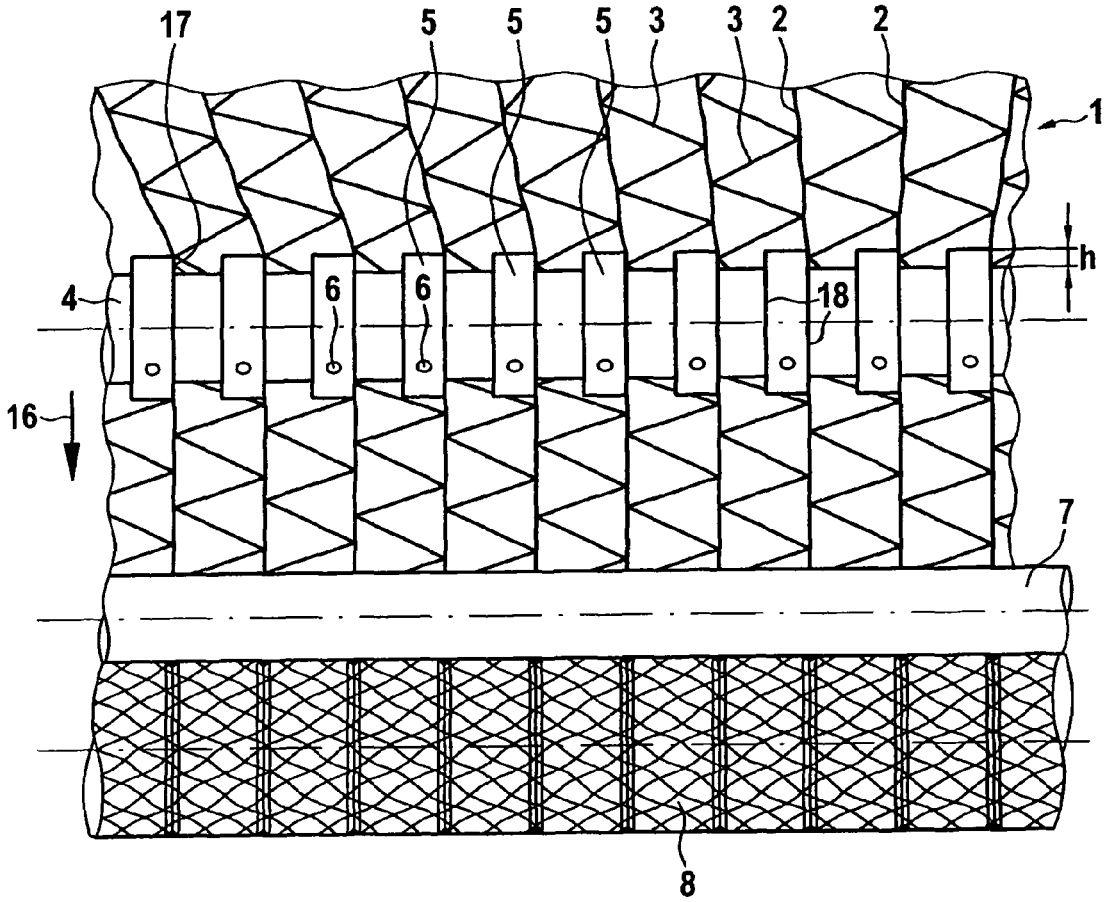

The present application is a National Stage of International Application No. PCT/EP2005/001561, filed Feb. 16, 2005, which is based upon and claims the benefit of priority from prior German Patent Application No. 20 2004 002 592.2, filed Feb. 19, 2004, and German Patent Application No. 10 2004 008 105.0, filed Feb. 19, 2004.

The invention relates to a process for the winding of nets knitted from thrums (i.e. threads in longitudinal direction during the manufacture of nets in production direction) and wefts (i.e. threads in transverse direction during the manufacture of nets) to a given winding width at a winding point. Threads are preferably to be understood here as film strips, i.e. strips produced by the slitting in longitudinal direction of flat films that take on a thread character by stretching in longitudinal direction. Furthermore, the invention also relates to a device for the performance of the process.

Knitted nets of this type are employed, for example, in agriculture for wrapping crop bales. For this it is necessary, for example, that the net does not contract in transverse direction due to the tensile forces applied in longitudinal direction during wrapping, so that the net width necessary or desired for many applications is retained. In order to achieve this, for example, stretcher devices are employed in the net feeder devices of agricultural round balers. Optimum wide running is dependent here, however, on the correct setting of the net roll brakes and stretcher devices.

"Raschel nets" are frequently employed for wrapping the crop bales. These are characterised in that thrums running in longitudinal direction of the net are knitted together with wefts running relatively diagonally to the thrums with a resulting "zigzag form" to produce a net. The structure of such raschel nets employed for round bale nets is described, for example, in DE 200 08 520 U1.

In order to prevent the net from contracting during wrapping of the round bales (i.e. to prevent the net from shrinking at right angles to the thrums when a tensile force is applied), EP 1 369 516 A1 describes a modification of a knitting machine in which the wefts are extended with the same spacing of the thrums. As a result of this relative (i.e. in relation to an arrangement of the wefts without thread reserve) extension of the wefts, there is no tension on the weft threads during removal of the net from the knitting machine and the subsequent coiling of the net so that the net does not contract. The extended wefts are obtained by the use of a wave-like needle bed in the knitting machine. The wave-like needle bed is designed such that the thrums each run between two peaks while the wefts are guided over the peaks. The length of the wefts in the net is determined by the height of the peaks between the thrums.

One disadvantage of this process is that when using a knitting machine for raschel net production that has been correspondingly modified, a net contains less thrums than a net of the same width produced on a non-modified raschel knitting machine. This reduces the tear strength of the net in longitudinal direction. A further disadvantage is that the needle bed has to be replaced every time a different length of the wefts between the thrums is desired.

The object of the present invention is to provide a process by which a knitted net can be wound to a random reduced winding width compared with the width of the knitted net. A further object of the present invention is to provide a device for the performance of the process.

The object is achieved by a process for winding nets knitted from thrums and wefts to a given winding width at a winding point in which the thrums of the knitted net are guided along spacer elements before reaching the winding point.

The object is furthermore achieved by a device for winding nets knitted from thrums and wefts to a given winding width at a winding point in which spacer elements are positioned ahead of the winding point along which the thrums of the knitted net are guided.

One advantage of the use of spacer elements ahead of the winding point along which the thrums are guided is that knitted nets with a random number of thrums can be wound to a given winding width. This enables on the one hand the tension of the wefts of the wound net to be set, and on the other hand it is also possible to manufacture the net wider with additional thrums and nevertheless to wind it to the desired width for practical use in roll form. As a result of the additional thrums, the tear strength of the net in use (e.g. during unwinding and wrapping of crop bales) is increased, as with a constant tensile force on the net, more thrums absorb this tensile force over the same width so that a lower tensile force acts on the individual thrum.

A further advantage of guiding the thrums along the spacer elements during winding of the net is that a clean edge form of the net wound into the net roll is obtained. Nets whose thrums are not guided along spacer elements during winding tend to have an irregular edge form.

Knitted nets in the sense of the invention are all nets in which a group of threads runs parallel to the longitudinal edge of the net. These threads are referred to as thrums. The individual thrums are linked by transverse threads that are referred to as wefts. The wefts can run here perpendicularly to the thrums or diagonally to them. The invention is particularly preferred and suitable for raschel nets in which the wefts run in zigzag form between the thrums.

In one variant of the process, the width of the net is additionally reduced by reducing the distance between individual or all the thrums even before the reduction of the winding width at the winding point. This reduction of the distance between the thrums increasingly leads to the wefts between the thrums in the wound net not being under tension. One advantage of the lack of tension in the wefts between the thrums is that the net does not contract when a tensile force is applied, for example, during unwinding.

In a preferred variant of the process, the winding width of the net can be adjusted by moving the spacer elements transversely to the running direction during winding. This allows different winding widths to be achieved with a constant number of thrums and an unchanged length of the wefts. In this way the winding widths can be adapted, for example, to the common but also to less common or even individual mounting systems of round balers employed in agriculture.

Weatherproof nets that, for example, can be employed in agriculture for wrapping crop bales are obtained in particular in that polyolefin strips, in particular of polyethylene, polypropylene or co-polymers of these or other co-components are employed as thrums and/or (in particular and) as wefts.

In the device for winding knitted nets, spacer rings mounted on a rod are preferably used as spacer elements. With a constant diameter of the rod, the spacer elements can be pushed along the rod according to the demanded winding width. The spacer elements are secured on the rod, for example, by a clamping mounting with slotted or split hub or as a clamping mounting with hollow key. Further mounting possibilities are, for example, a press fit with tapered clamping sleeve by clamping the spacer ring on the rod using a screw inserted radially through the spacer element. It is also possible to secure the spacer elements against slipping using spring-loaded or non-spring-loaded parallel keys or circlips.

A further possibility of varying the distance between the spacer elements is to design the rod on which the spacer elements are mounted as a threaded rod and to provide the spacer elements with an internal thread. A movement of the spacer elements in axial direction on the threaded rod is then preferably prevented by the use of lock nuts.

If it is not necessary to arrange the spacer elements movably on the rod, these can also be attached to the rod by welding, soldering or with a shrink fit. In this case it is also possible to provide the rod with grooves of random geometrical form in which the thrums are guided. In order not to damage the wefts, sharp-edged transitions should preferably be avoided. This is effected, for example, by rounding the edges.

In a preferred embodiment, the rod with the spacer elements has a rotationally symmetrical design and is mounted so that it can rotate. During winding of a net, the rod with the spacer elements rotates preferably with a circumferential speed corresponding to the speed of the net being wound. This avoids the net scraping over the rod and thus damage being caused to the net.

With non-rotationally symmetrical spacer elements, for example, if these are positioned at an angle or exhibit a radius along which the thrums run, these preferably have a fixed mounting so that they do not move during winding of the net. Spacer elements positioned at an angle can be, for example, spacer rings with an inclined side surface, ribs positioned at an angle on the rod or rods with a spiral rib.

The invention is additionally described in further detail below using a drawing.

Here

Figure 2:
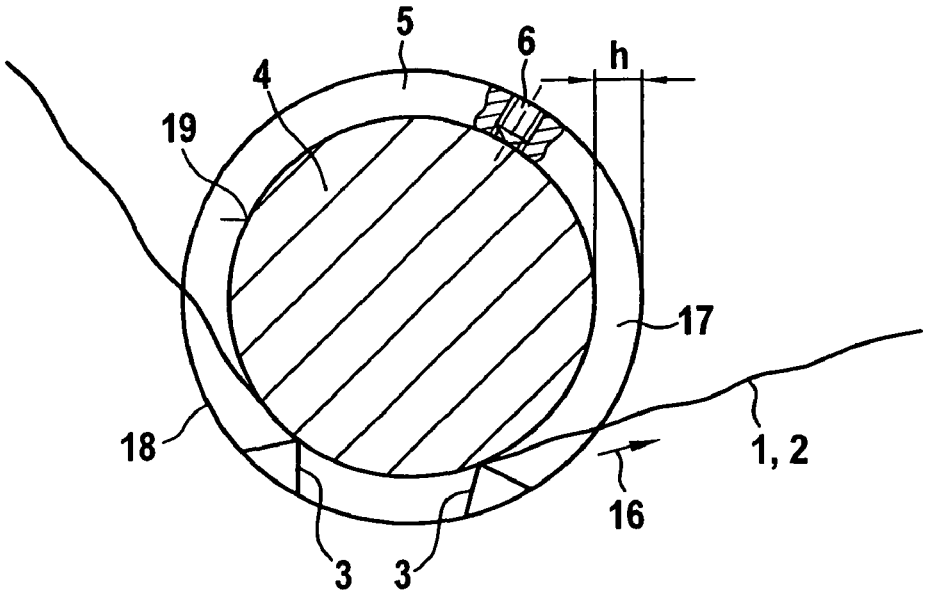
Figure 3:
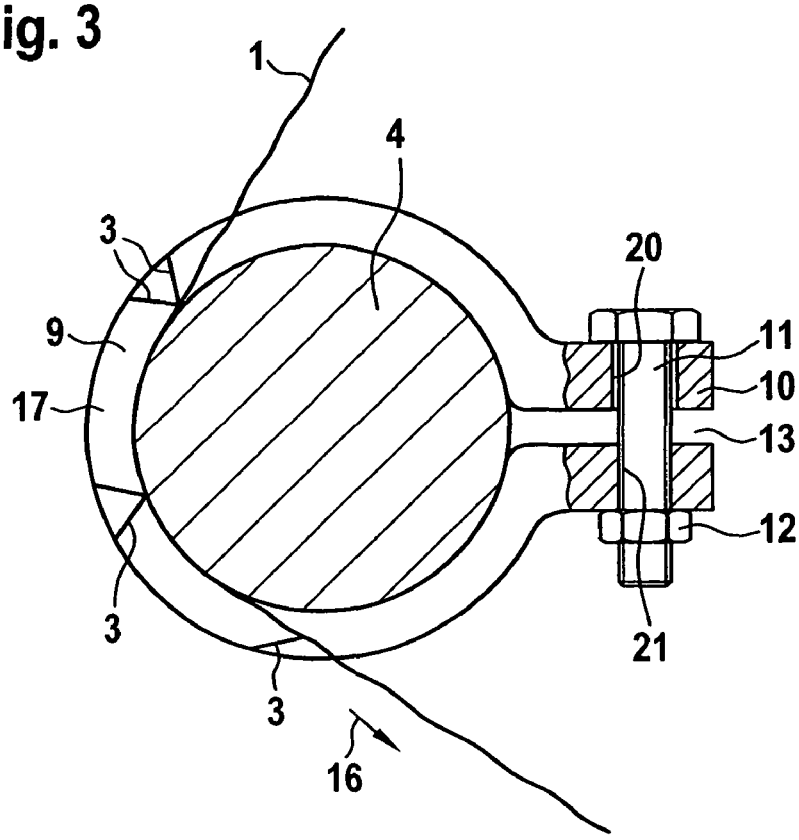
Figure 4:
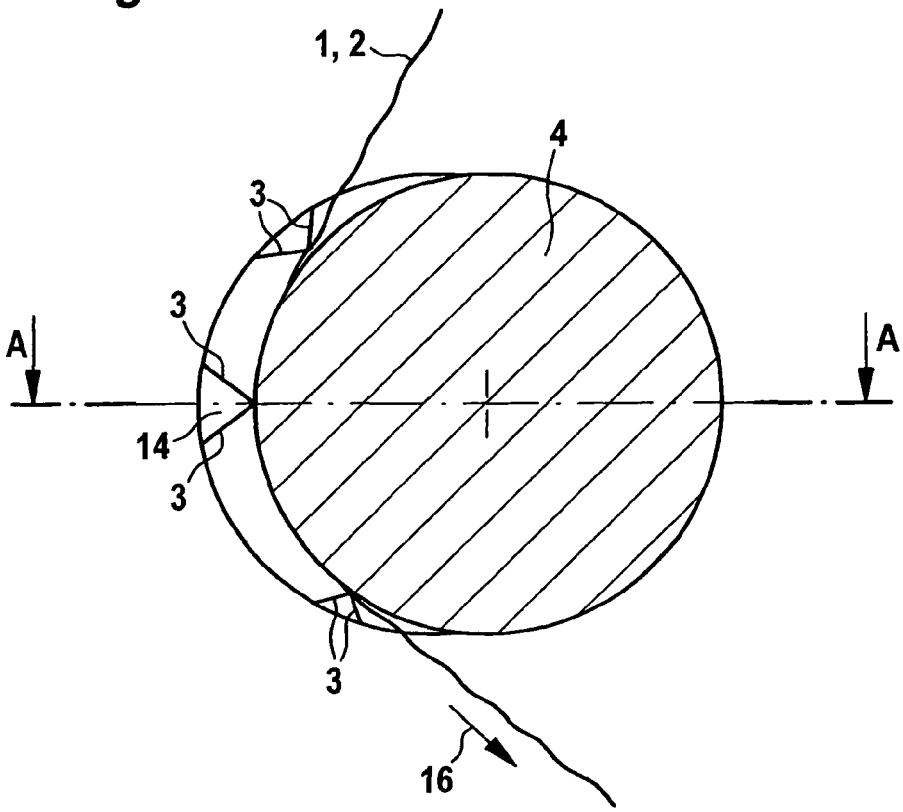
Figure 5:
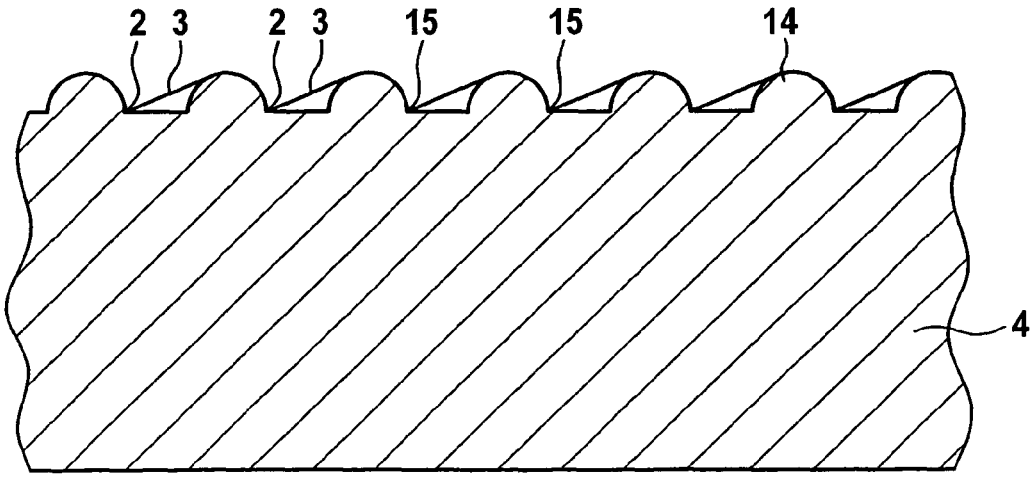

FIG. 1 shows a detail from a device for winding nets according to the invention, FIG. 2 shows a detail through a rod with spacer elements in a first embodiment, FIG. 3 shows a detail through a rod with spacer elements in a second embodiment, FIG. 4 shows a detail through a rod provided with ribs on one side as spacer elements, FIG. 5 shows a rod provided with ribs on one side as spacer elements.

FIG. 1 shows a detail from a device for winding knitted nets. A net 1 consisting of thrums 2 and wefts 3 is wound as a net roll 8. The net 1 shown here has the form of a raschel nets in which the thrums 2 run parallel to the pass direction 16 of the net. The thrums 2 are linked by zigzag running wefts 3 to form the net 1.

The net 1 leaves a knitting machine (not illustrated) on which it is produced. The length of the wefts 3 here corresponds to the side length of an equilateral triangle with the height of the triangle corresponding to the distance between the thrums 2. This results in the wefts 3 running taut between the thrums 2. As soon as a tensile force acts on the net 1 in the direction of the thrums 2, the net 1 contracts laterally. This contraction can be prevented if the wefts 3 run only loosely between the thrums 2. In order to achieve this, the (running) width of the net 1 is reduced before it is wound to form a net roll 8. This is achieved by the use of a rod 4 on which spacer rings 5 are mounted. In the embodiment illustrated in FIG. 1, the spacer rings 5 are fastened to the rod 4 using threaded pins 6 so that the spacer rings 5 cannot be moved in the axial direction of the rod 4.

In order to reduce the (running) width of the net 1 from the original production width to the winding width of the net roll 8, the thrums 2 are guided along one face 17 of each of the spacer rings 5. The individual spacer rings 5 are each positioned such that the distance between two thrums 2 is reduced. This reduction in distance results in the wefts 3 between the thrums 2 no longer being taut due to the reduced spacing.

In order to avoid damage to the wefts 3 while the net 1 is being guided over the rod 4 with the spacer rings 5, the height h of the face 17 of the spacer rings 5 must be adjusted or manufactured such that the wefts 3 are not tensioned as they pass over the spacer rings 5. With taut wefts 3 there is otherwise the risk that these will be cut on one edge 18 of the spacer ring 5.

The reduction in the distance between the thrums 2 at the spacer rings 5 of the rod 4 and the consequent slack wefts 3 between the thrums 2 result in the net 1 no longer contracting in lateral direction when a tensile force acting in the direction of the thrums 2 is applied.

After passing the rod 4 with the spacer rings 5, the net 1 is wound up as a net roll 8. In order that the net 1 is not distorted during winding as a net roll 8 and in order that winding is performed with a constant force, the net 1 is guided around a pressure roller 7. The pressure roller 7 presses uniformly onto the forming net roll 8, guaranteeing a uniform creation of the net roll 8.

Apart from the raschel net illustrated in FIG. 1, the rod 4 with the spacer rings 5 for adjusting the distance between the thrums 2 and hence the net width can be used for any type of net in which thrums 2 run parallel to the pass direction 16. The thrums 2 can be lined here by wefts 3 that can run at practically any angle between <180° and less (>0°) to the pass direction.

If the device is to be used to wind nets with always the same number of thrums 2 to always the same net width, then instead of the rod 4 with the spacer rings 5, another type of rod 4 can also be employed in which grooves are provided at the positions where the thrums 2 are to run. The grooves here can take any cross-section known to a person skilled in the art.

FIG. 2 shows a section through the rod with the spacer rings illustrated in FIG. 1.

In order that the spacer rings 5 can be moved on the rod 4 to be able to set different winding widths, the rod 4 preferably has a constant cross-section. During winding of the net 1, the spacer rings 5 are held in their axial position on the rod 4. For this they are clamped, for example, on the rod 4 with grub screws 6.

If the length of the grub screws 6 is not greater than the height h of the face 17 of the spacer ring 5, the rod 4 can be installed so that it rotates during winding of the net 1 at the same circumferential speed with which the net 1 moves in pass direction 16. This avoids the wefts 3 scraping over the edges 18 of the spacer rings 5 and thus being damaged.

In order that the thrums 2 cannot slip, a sufficiently large tensile force is preferably applied to the net 1 that the thrums 2 run along the surface 19 of the rod 4.

Apart from the circular cross-section of the rod 4 illustrated in FIG. 2, it can also have any other cross-section known to a person skilled in the art. The rod 4 can thus have, for example, a cross-section in the form of a polygon with at least three corners, an oval or an elliptical cross-section.

FIG. 3 shows a section through a rod with the spacer rings in a further embodiment.

In the embodiment illustrated in FIG. 3, the spacer elements 9 are arranged in the form of a clamp on the rod 4. Here the spacer element 9 tapers out on one side into two opposing legs 10. In order to fix the spacer element 9 on the rod 4, a bore 20 is preferably provided in one leg 10 and a thread 21 is preferably provided in the second leg 10. Instead of the thread 21, the second leg 10 can also be provided with a bore. In order to fix a spacer element 9 on the rod 4, a retaining element 11, preferably a screw, is inserted through the opening in the first leg 10 and screws into the thread 21 in the second leg 10. The spacer element 9 is secured on the rod 4 by tightening the screw 11. If both legs 10 are provided with a bore, a screw 11 with nut 12 is preferably used to secure the spacer element 9 on the rod 4.

In view of the legs 10, the spacer element 9 illustrated here can only be installed if the rod 4 does not move. If the rod 4 were to rotate, the legs 10 would otherwise possibly damage the net or lift the thrums 2 out of their guide along the face 17 of the spacer element 9.

Apart from the spacer ring 5 as a type of spacer element illustrated in FIG. 2 and the type of spacer element 9 illustrated in FIG. 3, any other type of spacer element known to a person skilled in the art can be employed that can be secure to the rod 4. If the rod 4 moves with the net, it is necessary for the face 17 of the spacer element 5, 9 to have the same height h over the whole circumference. If the rod 4 does not move, the height h in the area of the spacer element 9 in which the net is guided over the rod 4 should be constant.

FIG. 4 shows a further embodiment of a rod with which the winding width of the net is adjusted.

Apart from the spacer rings 5 or spacer elements 9 that can be moved on the rod 4, ribs 14 can also be formed on the rod 4 as a further type of spacer element if the winding width and the number of thrums 2 is not to be changed. As illustrated in FIG. 4, the ribs 14 can extend over only part of the rod 4 or can completely surround the rod 4 in the same way as the spacer rings 5. If the ribs 14 extend over only part of the rod 4, it is not possible to allow the rod 4 to rotate at a circumferential speed corresponding to the speed of the net 1, as otherwise the thrums 2 could regularly slip at the positions where there is no rib 14.

FIG. 5 shows a section along the line AA in FIG. 4.

In order to avoid the wefts 3 being damaged as the net is drawn over the rod 4, the ribs 14 have, for example, a semi-circular cross-section. The thrums 2 lie against one contact surface 15 of the ribs 14 and are thus guided to the winding width.

Apart from the semi-circular cross-section illustrated in FIG. 5, the ribs 14 can also have any other cross-section known to a person skilled in the art. The ribs can, for example, have a parabolic or elliptical cross-section or a cross-section in the form of a polygon with at least three corners. In the case of a cross-section in the form of a polygon, the corners are preferably rounded to avoid damage to the wefts 3.

REFERENCE NUMBER

1 Net
2 Thrum
3 Weft
4 Rod
5 Spacer ring
6 Threaded pins
7 Pressure roller
8 Net roll
9 Spacer element
10 Leg
11 Screw
12 Nut
13 Gap
14 Rib
15 Contact surface
16 Pass direction
17 Face
18 Edge
19 Surface of the rod 4
20 Bore
21 Thread
h Height of the face 17

The invention claimed is:

1. A process for the winding of nets knitted from thrums and wefts to a given winding width at a winding point, comprising guiding the thrums of the knitted net along spacer elements ahead of the winding point after the net has been knitted, wherein the winding width of the net is reduced by the spacer elements.

2. The process according to claim 1, wherein the thrums run parallel to the pass direction of the net between the spacer elements and the winding point.

3. The process according to claim 1, wherein the reduction in the winding width of the net is effected by reducing the distance between the thrums.

4. The process according to claim 3, wherein due to the reduction in the distance between the thrums, the wefts between the thrums in the wound net are not under tension.

5. The process according to claim 1, wherein the winding width is set by moving the spacer elements transversely to the pass direction of the net.

6. The process according to claim 1, wherein the spacer elements rotate at a circumferential speed about an axis transversely to the winding direction of the net, with the circumferential speed corresponding to the speed of the net.

7. The process according to claim 1, wherein polyolefin strips are employed as thrums and wefts.

8. A device for winding knitted nets that have been knitted from thrums and wefts to a given winding width at a winding point, comprising spacer elements which are arranged ahead of the winding point along which the thrums of the knitted net are guided, wherein the winding width of the net is reduced by the spacer elements.

9. The device according to claim 8, wherein spacer rings are located on the rod as spacer elements.

10. The device according to claim 8, wherein the spacer elements are formed as ribs on a rod.

11. The device according to claim 8, wherein the spacer elements rotate about an axis transversely to the winding direction of the net during winding of the net.

12. The device according to claim 8, wherein the spacer elements do not move during winding of the net.

13. The device according to claim 8, wherein the distance between the spacer elements corresponds to the distance between the thrums of the wound net.

14. The device according to claim 8, wherein the spacer elements can be moved transversely to the pass direction of the net.

15. A process for the winding of nets knitted from thrums and wefts to a given winding width at a winding point, comprising knitting a net from thrums and wefts with a knitting machine, and guiding the thrums of the knitted net along spacer elements ahead of the winding point after the net has been knitted and after the net has left the knitting machine, wherein the winding width of the net is reduced by the spacer elements.

16. The process according to claim 15, wherein the thrums run parallel to the pass direction of the net between the spacer elements and the winding point.

17. The process according to claim 15, wherein the reduction in the winding width of the net is effected by reducing the distance between the thrums.

18. The process according to claim 17, wherein due to the reduction in the distance between the thrums, the wefts between the thrums in the wound net are not under tension.

19. The process according to claim 15, wherein the winding width is set by moving the spacer elements transversely to the pass direction of the net.

20. The process according to claim 15, wherein the spacer elements rotate at a circumferential speed about an axis transversely to the winding direction of the net, with the circumferential speed corresponding to the speed of the net.

21. The process according to claim 15, wherein polyolefin strips are employed as thrums and wefts.

* * * * *